United States Patent [19]

Puchko et al.

[11] 4,016,738

[45] Apr. 12, 1977

[54] TRAVERSE WEDGE FORMING MACHINE

[76] Inventors: Alexandr Vladimirovich Puchko, ulitsa Sedykh, 64, kv. 2; Valery Alexandrovich Klushin, ulitsa Prityskogo, 52, kv. 25; Georgy Vasilievich Andreev, ulitsa Orlovskaya, 81, kv. 51; Eduard Matveevich Gorbunov, ulitsa Koltsova, 26, kv. 111; Evgeny Markellovich Makushok, ulitsa Sovetskaya, 2, kv. 3; Valery Yakovlevich Schukin, ulitsa Akademicheskaya, 11a, kv. 7; Vladimir Mironovich Segal, ulitsa V.Khoruzhei, 35, kv. 74, all of Minsk, U.S.S.R.

[22] Filed: Apr. 27, 1976

[21] Appl. No.: 680,810

[52] U.S. Cl. ..... 72/90; 72/469

[51] Int. Cl.[2] ..... B21H 7/18

[58] Field of Search ..... 72/90, 88, 469

[56] References Cited

UNITED STATES PATENTS

| | | | |
|---|---|---|---|
| 319,754 | 6/1885 | Simonds | 72/469 |
| 429,388 | 6/1890 | Rogers | 72/90 |
| 609,201 | 8/1898 | Hathorn | 72/90 |
| 3,954,001 | 5/1976 | Tsakamoto | 72/469 |

*Primary Examiner*—Milton S. Mehr
*Attorney, Agent, or Firm*—Fleit & Jacobson

[57] ABSTRACT

A transverse wedge forming machine is mainly designed for producing (forming) bodies of revolution, such as stepped shafts.

The transverse wedge forming machine of the present invention comprises a housing wherein two parallel plates: a movable and a fixed one, are mounted opposite to each other. The movable plate is mounted in longitudinal slideways of said housing. Each of said plates mounts a composite-in-length wedge-shaped forming tool, the components of each of said forming tools being arranged in a single row in a direction normal to said longitudinal slideways so that the tops of the adajcent components are directed at the opposite sides. The machine comprises also a device adapted for adjusting reciprocating displacement of a part, being formed, from one component of the forming tool disposed on the fixed plate to its next component.

This results in a substantial reduction in the machine length and obviates an inefficient idle stroke of said movable plate, with the ensuing considerable increase in machine production rates.

11 Claims, 18 Drawing Figures

TRAVERSE WEDGE FORMING MACHINE

The present invention relates to roll-forming equipment and more particularly to transverse wedge forming machines.

The invention may prove to be most advantageous in production bodies of revolution, such as stepped shafts.

Known in the art are transverse wedge forming machines whose housings enclose longitudinal slideways with a movable plate mounted therein and carrying a composite-in-length wedge-shaped forming tool disposed concordantly to said longitudinal slideways, a top of said tool being directed towards the transfer of said movable plate during the forming operation. Moreover, mounted in the machine housing with a possibility of adjusting reciprocating displacement towards the movable plate and parallel thereto is a fixed plate also carrying the composite-in-length wedge-shaped tool whose top is directed at the side opposite to the travel of said movable plate during the forming operation, the forming tools being disposed with a clearance therebetween to receive a part to be formed.

In said machines the forming tools are made composite, the components of each tool being mounted one after another concordantly to the longitudinal slideways. The length of each said forming tool is equal to at least five lengths of the part being formed. The fixed plate is mounted on the housing with the help of an intermediate wedge-shaped plate designed for providing the adjusting reciprocating displacements of said fixed plate and for adjusting the clearance between the forming tools that are fastened on the internal sides of both plates.

The forming tool has forming edges interacting with the part and reducing its diameter by revolving said part about its axis with the ensuing elongation of said part, forming, thus, the prescribed profile of the part. Forming commences at the centre of the part and comes to an end at its peripheral sections.

The forming operation is accomplished on a preheated part, with the movable plate being displaced in the same direction.

Forming completed, the movable plate returns to its initial position, whereupon the next part is subjected to the forming process. For production each part the movable plate must perform two strokes, of which one is an idle stroke. At the beginning of the forming process the tops of said forming tools are disposed one above the other, while at the end of said process their end faces are located one above the other. Therefore the minimum length of the prior-art machines is thrice the tool length.

Thus, the inherent construction of the prior-art machines predetermines a comparatively large length of their forming tools and, consequently, of the machine as a whole. An idle stroke that is required to return the movable plate with the forming tool to its initial position results in inefficient time consumption, which imposes a limitation on the production rates of said machines.

As the part is formed in one pass of the forming tool, during forming the mass of metal is displaced from the central section of the part being formed to its end faces, said displacement being half as great as the part length. This creates unfavourable forming conditions.

The design of the prior-art forming tool permits only parts in high-ductility materials to be formed, insofar as the forming of parts in low-ductility materials causes their failure at the centre of the part section.

Moreover, said tool is adaptable only for symmetrical parts. Simultaneous forming of a part having sections of various diameters results in its twisting and warping stemming from various angular forming velocities in said sections. A reduction in length of the forming tool below certain limits causes either the slipping of a part being formed or transverse rupture of its central portion.

Disadvantages of said prior-art forming machines include also the difficulties encountered during their dismantling and a need for subsequent adjustment in case of jamming of a part being formed which may occur, e.g., due to its insufficient heating.

Moreover, said machines fail to provide an adequate dimensional accuracy of part diameters. Part accuracy is responsive to temperature conditions of machine units which tend to vary in service, as well as to elastic deformation of the machine housing brought about by variations in the forming force, for instance, in view of unstable preheating temperature of the parts being formed.

The main object of the present invention is to reduce the machine length.

Another object of the invention is to provide a substantially higher production rate.

Still another object of the invention is to broaden the technological potentialities of the machine.

Yet another object of the present invention is to enhance the accuracy of parts to be formed on the machine.

Said and other objects of the invention are accomplished by providing a transverse wedge forming machine whose housing is fitted with longitudinal slideways wherein is mounted a movable plate carrying a composite-in-length wedge-shaped forming tool arranged concordantly to said longitudinal slideways, a tool top being directed towards the transfer of said movable plate as a part is being formed, and with a fixed plate that is mounted with a possibility of adjusting reciprocating displacements towards the movable plate and parallel thereto, said fixed plate also carrying the composite-in-length wedge-shaped forming tool with a top directed at the side opposite to the travel of said movable plate during the forming operation, said forming tools being disposed with a clearance to receive a part being formed.

According to the invention, the components of each of said forming tools are located in a single row in a direction normal to the longitudinal slideways so that the tops of the adjacent forming tool components are directed at the opposite sides, and provision is made for a device adapted for adjusting reciprocating displacement of the part being formed from the end face of the previous component of said forming tool arranged on the fixed plate to that of its next component from the side of its top.

Said embodiment enables a considerable reduction in the machine length, insofar as the tool length diminishes as many times as many components it has. The machine width is the function of three factors: the width of the slideways of said movable plate, thickness of housing walls and the plate width. In this case only one of said factors has been changed — the plate width that is dependent on the tool width. As the machine width is increased negligibly, as compared with the reduction in its length, the overall dimensions of the proposed machine have diminished materially.

As the tops of the adjacent components of said forming tools disposed on each of said plates are directed at the opposite sides and due to the provision of the device for adjusting displacement of the part being forming from the end face of the previous component of the tool arranged on the fixed plate towards that of its next component from its top side, forming is performed both during the forward and return strokes of the movable plate. This obviates an idle stroke and contributes to a substantially higher production rates.

According to one of possible embodiments of the invention, each of said forming tool components is made up of at least three wedges mounted in a single row in a direction normal to the longitudinal slideways, the tops of said wedges in each component being directed at the same side, and forming edges of the adjacent wedges being mounted at an angle to each other.

With the above embodiment of the forming tool three and even more sections of the part can be formed simultaneously. This reduces substantially the tool length without impairing the quality of the finished part.

The adopted arrangement of the adjacent wedges whose forming edges are angled to each other creates the same forming conditions for both the central and peripheral sections of the part being formed. Elongation of the part sections formed by the action of the central wedges is offset due to the arrangement of the forming edges of the peripheral wedges, this precluding the warping and twisting of the part during the forming process.

According to another particular embodiment of the invention, each wedge of each forming tool component is provided with two forming edges, producing upon their intersection a forming blade running along the entire length of the wedge.

Said embodiment of the wedges offers a decrease in stresses in the central portion of the part cross-section during forming, a feature enabling parts in low-ductility materials to be formed without fructuring of the central portion of their cross-section.

According to still another embodiment of the invention, the forming edges of each wedge have a variable angle of elevation "$\gamma$" augmenting towards its top.

This allows producing rectilinear wedges which simplifies their fabrication and provides for uniform elongation of the part sections located between said wedges, said elongation varying in proportion to the displacement of said movable plate.

In accordance with still another particular embodiment of the invention, the wedges of each of the forming tool components are mounted on each plate with the help of a holder that is built up of sections arranged in a single row in a direction normal to said longitudinal slideways and having a possibility of reciprocating in that direction, each said section carrying at least a pair of said wedges fixed rigidly thereon.

Owing to the above arrangement each forming tool component can be made up of a relatively great number of said wedges, by which virtue the part can be formed simultaneously along its length, this allowing the length of the forming tool to be cut down and the machine production rate to be increased. Due to movable attachment of said wedges any production inaccuracies and wedge wear do not affect adversely the dimensional accuracy of the part being formed.

It is expedient that at least one of the extreme sections of said holder be spring-biased towards the central section.

This provides accurate initial registering in position of all the wedges that is necessary at the initial stage of the forming operation.

According to still another embodiment of the invention, each forming tool is provided with stepped forming edges, said steps being formed by stages parallel to a wedge plane, facing the plate which carries said wedge, and being disposed at the same height with respect to said plane in all the wedges.

Owing to said embodiment of the wedges, the machine accepts parts composed of sections of various diameters, and ensures an adequate dimensional accuracy, since it is capable of providing the same angular rotational velocity on the part sections of various diameters.

It is also expedient that said stages have transverse cust, which would preclude the slipping of the part being formed and stabilize its rotation ensuring therefore better quality of finished parts.

According to still another particular embodiment of the invention, the device for adjusting reciprocating transfer of the part to be formed from the end face of the previous component of said forming tool mounted on the fixed plate to that of its next component from the side of its top, comprises carriages mounting each a platform adaptable to accommodate a part to be formed thereon, said carriages being set up in mutually parallel to each other guides mounted on the planes of said fixed and movable plates, facing each other, in a direction normal to said longitudinal slideways, and disposed one above the other when the movable plate is brought into one of its extreme positions, the carriage located on the fixed plate being a driven one.

Said embodiment ensures an accurate adjusting transfer of the part to be formed to the next forming tool component and accurate registering of said part in position prior to its feeding into the clearance between the forming tools.

It is expedient that the platform mounted on the carriage set up on one of said plates be spring-biased towards the other plate.

The above attachment of said platform rules out thrust forces, providing reliable gripping of the part to be formed.

In accordance with one more embodiment of the invention, the fixed plate is fixed in the housings by pins to preclude its displacement along said longitudinal slideways.

Said embodiment simplifies the dismantling of the proposed machine in case of jamming of said movable plate. The pins act also as guides during vertical adjusting reciprocating displacements of the fixed plate.

The nature of the invention will be clear from the following detailed description of the particular embodiment to be had in conjunction with the accompanying drawings, in which.

Figure 1:
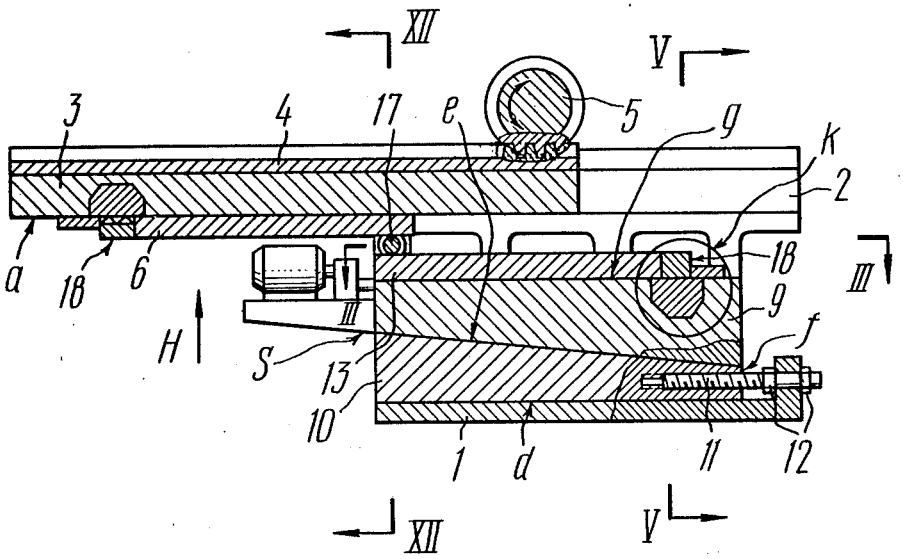
FIG. 1 shows diagrammatically a transverse wedge forming machine, according to the invention, (a longitudinal sectional view)

A transverse wedge forming machine comprises a C-shaped in cross-section housing 1 (FIG. 1) which is open from above. The top portion of said housing 1 has longitudinal slideways 2 in which is mounted horizontally a movable plate 3. Rigidly fixed on the top plane of said movable plate 3 parallel to the longitudinal slideways 2 is a rack 4 interacting with a driven gear wheel 5. The bottom plane *a* of the movable plate 3 mounts a wedge-shaped forming tool 6 whose forming edges 6*a* are provided with transverse cuts (FIG. 2) and calibrating planes 6*b*.

According to the invention, the forming tool is made composite, built-up, for example of two components 7 and 8. Said components 7 and 8 of the forming tool 6 are arranged in one row in a direction normal to said longitudinal slideways 2, the tops *b* and *c* of said components 7 and 8 being directed at the opposite sides.

Figure 2:
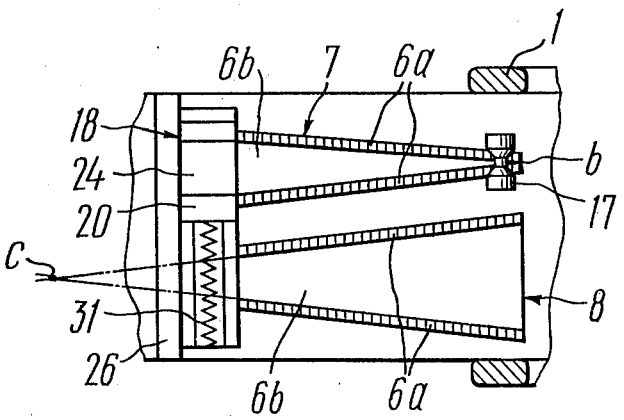
FIG. 2 shows, a view along arrow H in FIG. 1.

Set up in the housing 1 on its bottom part parallel to the movable plate 3 is a fixed plate 9 (FIG. 1), said plate 9 being mounted with a possibility of vertical adjusting reciprocating displacements towards the movable plate 3. To enable said displacements provision is made for an intermediate wedge-shaped plate 10 resting with its bottom plane *d* on the housing 1, its top plane *e*, that is inclined with respect to said plane *d*, mounting the fixed plate 9 whose bottom plane *s* is inclined with respect to its top plane *g* (as shown in FIG. 1).

Figure 3:
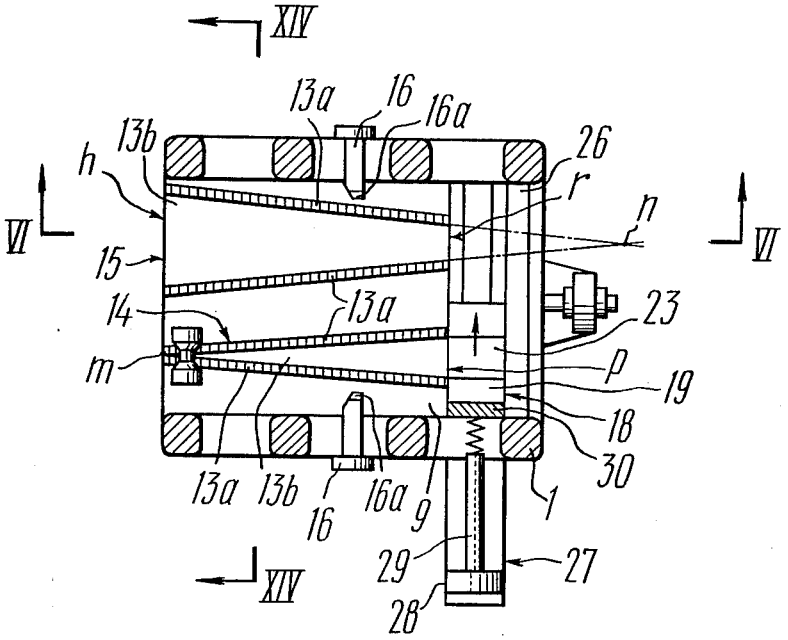
FIG. 3 shows, a section taken along III—III in FIG. 1.

To enable the transfer of said intermediate wedge-shaped plate 10, turned in its narrow end face *f* with one its end is a screw 11, whose other end is introduced through a hole in the housing 1 and is fixed with nuts 12. The top plane *g* of the fixed plate 9 facing the movable plate 3 mounts a forming tool 13 similar in construction to said forming tool 6. The forming tool 13 is composed of components 14 (FIG. 3) and 15 and is provided with forming edges 13*a* with transverse cuts (FIG. 3) and calibrating planes 13*b*.

The component 14 of the forming tool 13 is arranged under the component 7 of the forming tool 6, their tops *m* and *c* accordingly being directed at the opposite sides. The component 15 of the forming tool 13 is located under the component 8 of the forming tool 6, their tops accordingly *n* and *b* being also directed at the opposite sides.

Each side wall of the housing 1 (FIG. 3) is provided with holes located at the height of the fixed plate 9 and adapted to receive, according to the invention, pins 16 facing with their heads outwards. The free ends of said pins 16 are introduced into vertical slots 16*a* provided on the lateral faces of the fixed plate 9. The pins 16 are adapted to preclude the displacement of said fixed plate 9 in the direction of travel of the movable plate 3 (FIG. 1) during the forming operation. Moreover, the pins 16 (FIG. 3) act as guides for said fixed plate 9 during its adjusting reciprocating transfer towards the movable plate.

The movable plate 3 (FIG. 1) and fixed plate 9 are mounted so as to provide a clearance between the forming tools 6 and 13 to receive a part 17 to be formed.

According to the present invention, the housing encloses a device 18 (FIG. 3) adapted for adjusting reciprocating transfer of the part 17 to be formed from the end face *p* of the component 14 of the forming tool 13 to the end face *r* from the side of the top *n* of its next component 15.

Figure 4:
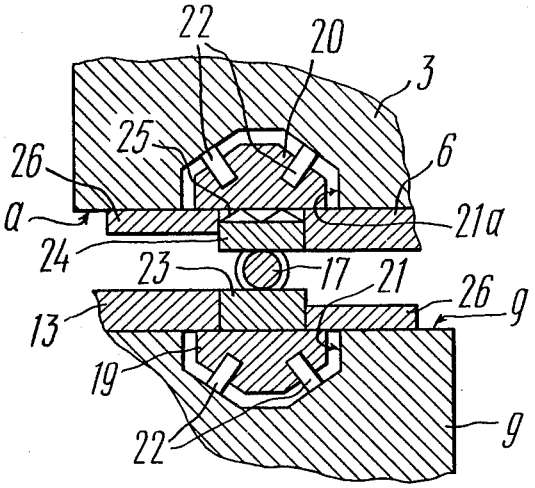
FIG. 4 shows, a scaled-up unit K in FIG. 1.

Said device 18 includes a carriage 19 (FIG. 4) that is mounted in guides 21 and a carriage 20 disposed in guides 21*a*. When the movable plate 3 is brought into one of its extreme positions, said carriages 19 and 20 are located one about the other.

The guides 21 and 21*a* are made in the form of shaped grooves (FIG. 4) provided accordingly in the fixed plate 9 and movable plate 3 on their planes *d* and *a* facing each other. The guides 21 and 21*a* are mutually parallel to each other and normal to the longitudinal slideways 2 (FIG. 1).

Each of said carriages 19 (FIG. 4) and 20 has rollers 22 mounted in the guides 21 and 21*a*. The carriage 19 mounts a rigidly fixed platform 23, and the carriage 20 a platform 24 set up with the help of disc springs 25. The profile of the surfaces of said platforms 23 and 24 corresponds to that of the part 17 being formed, said surfaces facing each other.

Each of said platforms 23 and 24 adjoins with one its edge the forming tool 13 or 6 accordingly. To prevent said carriages 19 and 20 from coming out of their guides 21 and 21*a*, each carriage 19 and 20 is pressed from its one edge by the appropriate forming tool 13 or 6 and from its other edge by a clamp 26 fixed rigidly on the corresponding plates 9 and 3.

Figure 5:
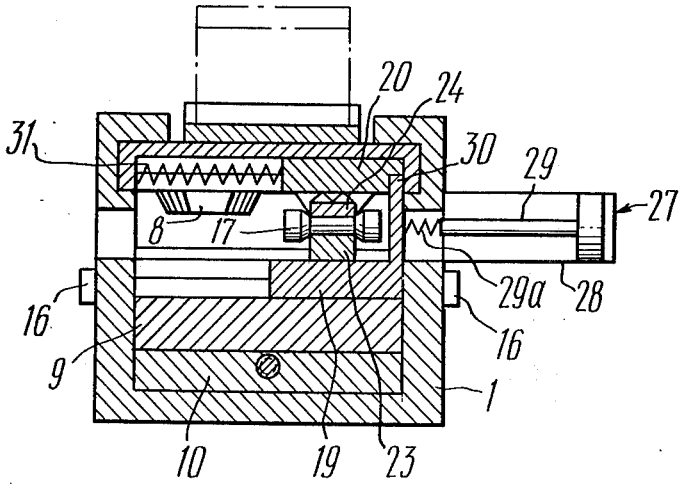
FIG. 5 shows, a section taken along V—V in FIG. 1 (with a movable plate brought into its extreme right-hand position)

The carriage 19 mounted in the guides 21 has a drive 27 (FIG. 5). Said drive 27 is made in the form of an air cylinder whose body 28 is rigidly fixed on the housing 1 and a rod 29 is connected with the carriage 19 through a spring coupling 29*a*. The carriage 19 has a projection 30 to interact with the carriage 20 during their travel. Mounted intermediate of the end faces of the carriage 20 and guides 21*a* is a spring 31 holding said carriage 20 tight to the projection 30.

Figure 6:
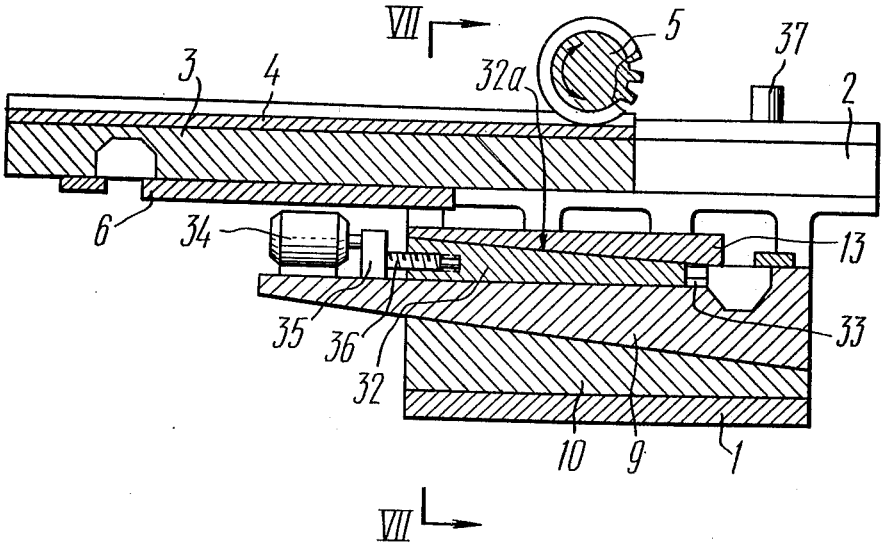
FIG. 6 shows, a longitudinal sectional view of a machine taken along the second forming tool component.

The component 14 (FIG. 3) of the forming tool 13 is rigidly fastened on the fixed plate 9. The component 15 of the forming tool 13 is set up on said fixed plate 9 by means of an additional wedge-shaped plate 32 (FIG. 6). The latter (the wedge-shaped plate 32) has a top surface 32*a* inclined lengthwise, and is installed in a longitudinal groove 33 in the fixed plate 9.

From the side of its narrow end face the fixed plate 9 mounts a drive engine 34 with a reducing gear 35. The free end of an output shaft 36 of said reducing gear 35 is threaded to be screwed in a hole in the wide end face of said additional wedge-shaped plate 32.

In the top part of the housing 1, close to the ends of the longitudinal slideways 2, is mounted a pickup 37 for sensing elastic deformation of said housing 1 while forming the part 17. Said pickup 37 is associated with the drive engine 34 by rendering to any prior-art electronic system which is not disclosed herein.

The bottom plane of the component 15 (FIG. 7) of the forming tool 13 is provided with a groove *t*, said component 15 being installed on the top inclined plane 32*a* of the additional wedge-shaped plate 32 by means of said groove *t*.

The wedge-shaped plate 32 is slightly less in width than the component 15 of the forming tool 13. The fixed plate 9 mounts two vertical pillars 38 arranged on both sides of said additional wedge-shaped plate 32. The top ends of said pillars 38 are inserted into blind holes in the bottom plane of the component 15.

Figure 8:
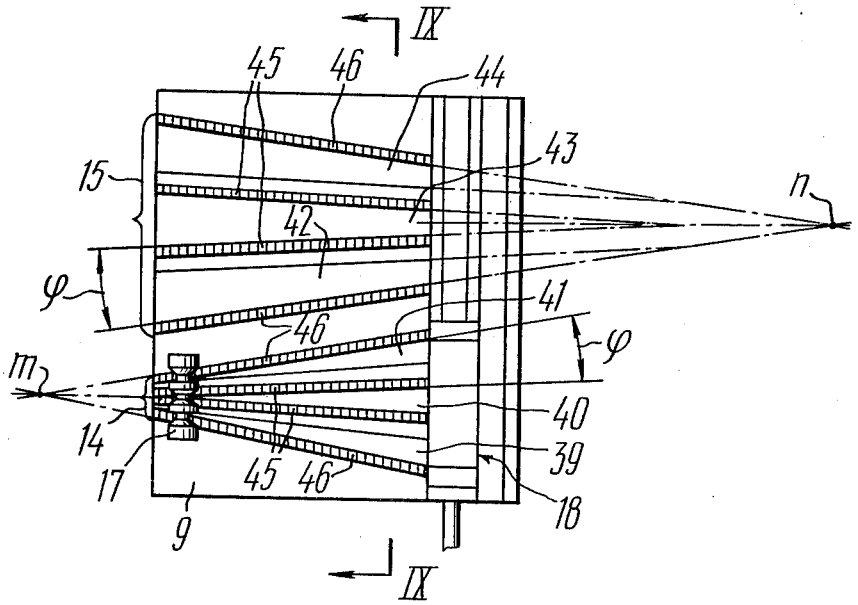
FIG. 8 shows, a forming tool located on a fixed plate, according to the invention.

According to one of the particular embodiments of the invention, each of said components 7 and 14, 8 and 15 of the forming tools 6 and 13 is made up of at least three wedges 39 through 41 and 42 through 44 accordingly (FIG. 8 shows the components 14 and 15 of the forming tool 13). The tops of said wedges 39 – 44 in each of said components 7, 8, 14 and 15 are directed at the same side. The wedges 39 through 41 and 42 through 44 are set up in one row in a direction normal to the slideways 2 (FIG. 1). The central wedges 40 (FIG. 8) and 43 have two forming edges 45 (FIG. 9), whereas the side wedges 39, 41, 42 and 44 are fitted with only one forming edge 46. To improve the interaction of the part 17 to be formed with said edges 45 and 46 both forming edges 45 and 46 have transverse cuts, as in shown in FIG. 8, and the wedges 39 through 44 of each component 7, 8, 14, 15 are mounted so that the forming edges 45 and 46 of the adjacent wedges, e.g., 40 and 41, 43 and 42 are located at an acute angle $\phi$ to each other.

According to another embodiment of the invention, each wedge of each component 7, 8, 14 and 15 of the forming tools 6 and 13 has two forming edges 47 (FIG. 10), producing upon their intersection a forming blade 48 running along the entire length of the wedge.

Figure 11:
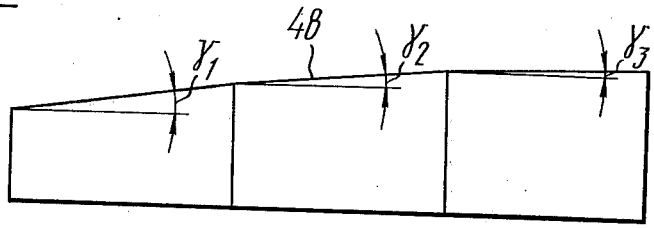
FIG. 11 shows, a view along arrow Q in FIG. 10.

The most favourable embodiment of said wedges ensuring high quality of a part being formed in a wedge with the forming edges 47 inclined at the same angle to its base plane 49. According to the invention, the forming edges 47 of each of said wedges 39 through 44 have a variable angle of elevation "$\gamma$" augmenting towards each of the tops *b* (FIG. 2), *c*, *m* (FIG. 3) and *n* of the appropriate components 7, 8, 14 and 15 of the forming tools 6 and 13, the edge 48 (FIG. 11) having also a variable angle of elevation "$\gamma$" augmenting in the same direction.

Figure 12:
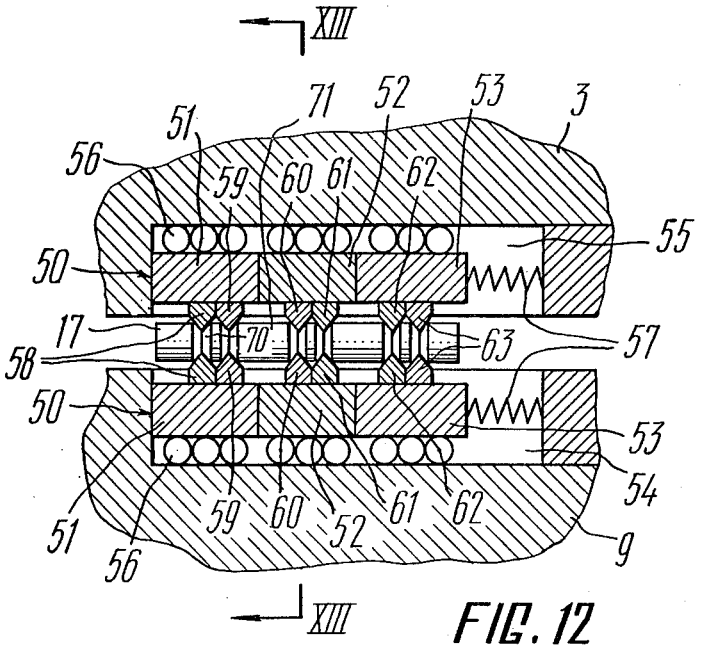
FIG. 12 shows, a section taken along XII—XII in FIG. 1, according to the invention, a fragmentary cut-away scaled-up view.
Figure 13:
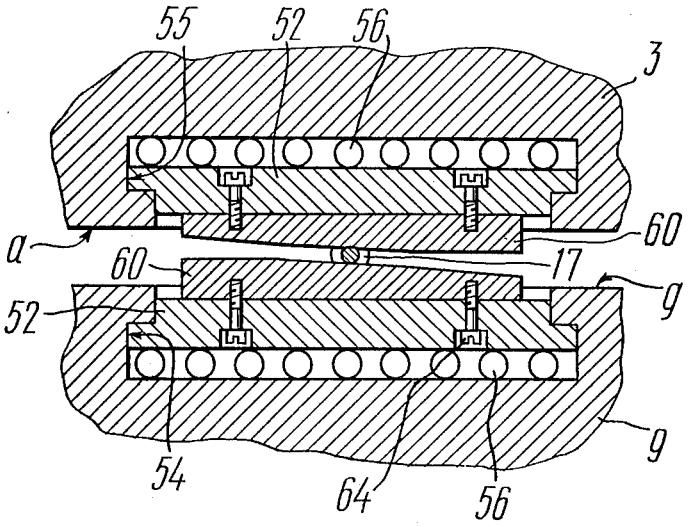
FIG. 13 shows, a section taken along XIII—XIII in FIG. 12.

According to another particular embodiment of the invention, the wedges 39 through 44 of each of said components 7, 8, 14, 15 are set up on each plate 3 and 9 with the help of a holder 50 (FIG. 12) made up of sections 51 through 53. The latter (the sections 51 through 53) are arranged in a single row in a direction at right angles to the longitudinal slideways 2 and reciprocably in said direction. To effect said movement each of said plates 3 and 9 has on its sides *a* and *g*, facing each other, appropriate T-shaped grooves 54 (FIG. 13) and 55 running in a direction normal to the longitudinal slideways 2, each said groove accommodating said sections 51 through 53 (as shown in FIG. 13). Mounted between the bottom of each groove 54 and 55 and the plane of each of said sections 51 through 53 (FIG. 12), facing said groove, are antifriction bearings 56, such as ball bearings. Moreover, a spring 57 is set up intermediate of the side wall of each of said grooves 54 and 55 and the side wall of each section 53 facing said first side wall. In this case it is expedient that each component 7, 8, 14 and 15 be provided with three pairs of wedges 58 through 63 having each the forming edge 48. The wedges 58 through 63 of each pair are mounted on one of said sections 51 through 53 so that the like forming edges 47 are located at an acute angle to each other. The wedges 58 and 59, 60 and 61, 62 and 63 of each pair are rigidly fixed by counter-sunk-headed screws 64 (FIG. 13) introduced through the holes in each of said sections 51 through 53.

Figure 14:
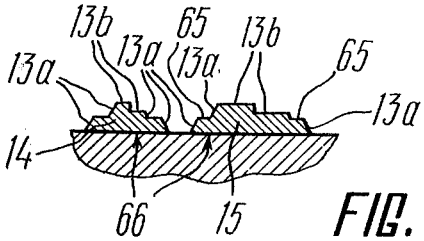
FIG. 14 shows, a section taken along XIV—XIV in FIG. 3, according to the invention (one of the embodiments)

According to still another embodiment of the invention, the forming edges 6*a*, 13*a*, 45, 46 and 47 of the forming tools 6 and 13 are stepped, the steps being formed by stages 65 (FIG. 14). Said stages 65 are parallel to a wedge base plane 66 facing its bearing plate 3 or 9, the stages being located for all the wedges at the same height with respect to said plate. The stages 65 have transverse cuts.

The herein-proposed transverse wedge forming machine functions in the following manner.

Before the forming process has been initiated, the machine is adjusted for parts of prescribed size. To this end the wedge-shaped plate 10 is carried along the longitudinal slideways 2 by rotating the screw 11 (FIG. 1) and effecting thereby said adjusting reciprocating displacement of the fixed plate 9 with respect to the plate 3.

Upon establishing a clearance between the forming tools 6 and 13 to suit the prescribed size of the part 17 to be formed, forming is accomplished.

Prior to this operation a loading unit (not shown in the drawing) feed the preheated part 17 into the clearance between the components 7 and 14 of the forming tools 6 and 13. To this end the machine power drive (not shown in the drawings) is cut in to provide counterclockwise rotation of the gear wheel 5 (in the drawing plane). The latter (the gear wheel 5) is in mesh with the rack 4 through which it carries the movable plate 3 along the longitudinal slideways 2 towards the end face *p* (FIG. 3) of the component 14 of said forming tool 13. Thus, the movable plate 3 performs its forward stroke during which the component 7 (FIG. 2) of the forming tool 6 and component 14 (FIG. 3) of the forming tool 13 are forced in the part 17 being formed, and make it roll from the top *m* of the component 14 of the forming tool 13 to the end face *p* of said component 14.

In this case the stock is exposed to the action of the forming edges 6*a* and 13*a* of the forming tools 6 and 13, said edges 6*a* and 13*a* displacing metal masses of the part 17 being formed from its central sections to peripheral ones, reducing the diameter of said part 17 with a corresponding elongation that results.

The calibrating planes 6*b* and 13*b* of the components 8 and 14 of the forming tools 6 and 13 are adapted to form cylindrical surfaces on the part 17 being processed. Where parts 17 of intricate configuration are to be formed, said calibrating planes 6*b* and 13*b* of the forming tools 6 and 13 have a profile corresponding to the prescribed contour of the part 17 to be formed. Due to the mechanical effect exerted by the shaped calibrating surfaces the part 17 of an intricate configuration can be formed.

The movable plate 3 is shifted until the platform 24 of the carriage 20 is located above the platform 23 of the carriage 19. After that the machine power drive rotating the gear wheel 5 is switched off and the movable plate 3 is stopped, the part 17 rolling off the component 14 of the forming tool 13 on the platform 23 (FIG. 3) where it is registered in position between the platforms 23 and 24 whose profile corresponds to that of the part 17 being formed.

This rules out axial displacement of the part 17 to be formed during its travel from one component 14 of the forming tool 13 to its next component 15.

Following that the air cylinder 27 is actuated. The rod 29 of said air cylinder 27 forces the carriage 19 along the guides 21 towards the next component 15 of the forming tool 13. Any inaccuracy in the transfer of the rod 29 is made up for by the spring coupling 29*a*. The projection 30 (FIG. 5) of the carriage 19 interacts with the carriage 20, carrying it in the guides 21 together with the carriage 19. The part 17 to be formed registered in position between the platforms 23 and 24 is shifted together with said carriages 19 and 20. The disc springs 25 arranged between the platform 24 and carriage 20 relieve the rollers 22 from considerable thrust loads arising during said transfer, facilitating thereby the travel of said carriages 19 and 20 in the guides 21.

The carriage 19 is shifted until the profile of said platforms 23 and 24 is strictly in register with that of the components 8 and 15 of the forming tools 6 and 13.

After that the machine power drive is cut in again. As a result, the gear wheel 5 starts revolving clockwise and the movable plate 3 commences to move to the left (in the plane of FIG. 1). In this case the part 17 will roll into the clearance between the components 8 and 15 of the appropriate forming tools 6 and 13 owing to the transfer of said platforms 23 and 24 being shifted relative to each other. Under the effect of the forming edges 6*a* and 13*a* of said components 8 and 15 the forming process is continued on the peripheral sections of the part 17 being formed.

The part 17 to be formed, on being rotated, approaches the end face *h* (FIG. 3) of the component 15 of the forming tool 13 to roll down from said component 15 into a receptacle (not shown in the drawing) located at the machine of the invention.

During the return stroke of the movable plate 3 the carriage 19 (FIG. 5) with the platform 23 returns to its initial position under the effect of the rod 29 of the air cylinder 27. The spring 31, on being released, returns the carriage 20 with the platform 24 fastened thereon to its initial position.

Further, the next part 17 to be formed is placed in the clearance between said components 7 and 14, the forming process being repeated by observing the above-outlined sequence of operations.

To make up for wear of the forming tools 6 and 13 the machine must be readjusted. To this end the clearance between said forming tools is adjusted with the aid of the screw 11 (FIG. 1) and the wedge-shaped plate 10 to suit the prescribed value.

Moreover, the herein-proposed machine can be readjusted automatically during the forming operation to suit the preset size of a part 17 to be formed, this being effected by means of the additional wedge-shaped plate 32 (FIG. 6) linked mechanically through the drive engine 34 with the pickup 37.

Figure 7:
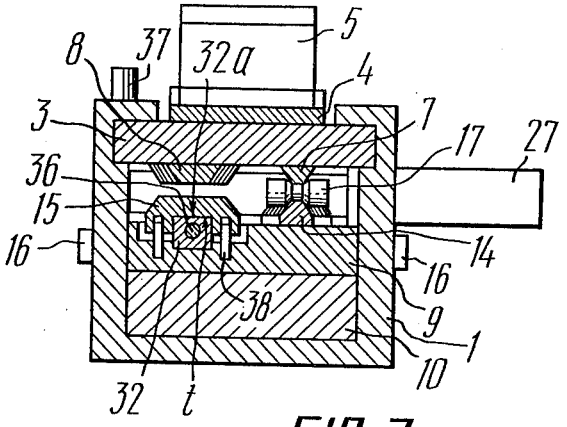
FIG. 7 shows, a section taken along VII—VII in FIG. 6.

As the part 17 is being formed by the components 7 and 14 of the forming tools 6 and 13, the pickup 37 registers the elastic deformation of the housing 1 brought about by the thrust load during forming. A signal arriving from the pickup 37 is processed by an electronic control system and the shaft rpms of said drive engine 34 are varied depending on the elastic deformation of said housing 1. Rotation is transmitted from the shaft of said drive engine 34 through the reducing gear 35 to its output shaft 36. Turning clockwise or counterclockwise the shaft 36 is screwing in or out of the threaded hole in the additional wedge-shaped plate 32, displacing it along the groove *t* (FIG. 7). As a result of said displacement of the additional wedge-shaped plate 32 the component 15 of the forming tool 13 arranged on said wedge-shaped plate 32 moves vertically adjusting thereby the value of the clearance between the forming tools 6 and 13. This obviates the thrust loads exceeding the permissible value and, hence, rules out emergency situations.

Where the plate 3 is jammed (FIG. 3), which may occur, e.g. while feeding an insufficiently heated part 17 into the clearance between the forming tools 6 and 13, the pins 16 are removed from the holes they are introduced in to release the fixed plate 9. Then upon cutting in the machine drive the movable plate 3 is shifted towards the inclination of the wedge-shaped plate 10 (FIG. 1).

The fixed plate 9 is entrained together with the movable plate over the inclined plate *e* of the wedge-shaped plate 10.

As a result of that displacement the clearance between the forming tools 6 and 13 will increases. Next the jammed part 17 being formed is taken out, the fixed plate 9 returns to its initial position wherein it is again registered by pins 16 and the forming operation is recommenced.

Figure 9:
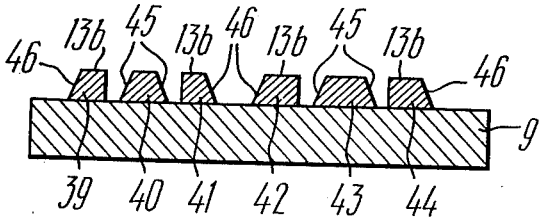
FIG. 9 shows, a section taken along IX—IX in FIG. 8.
Figure 15:
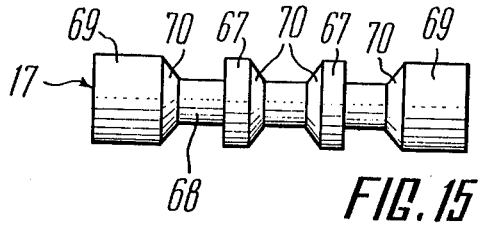
FIG. 15 shows a part being formed by composite forming tools, with each component of said tools being made up of three wedges.

In case extremely long parts 17 are to be formed, it is expedient that the forming tools 6 and 13 be employed, each component 7, 8, 14 and 15 of said tools being made up, according to the invention, of three wedges 39 through 41 and 42 through 44 arranged in a single row in a direction normal to the longitudinal slideways 2, as shown in FIGS. 8 and 9. This will diminish materially the length of the forming tools 6 and 13. During the forming operation the wedges 39, 40 and 41 penetrate simultaneously into the three sections of said part 17 being formed, as is shown in FIG. 15. The arrangement of said sections is calculated so that the volume of metal in the sections 67 of the part 17, arranged intermediate of its sections 68 wherein the forming tools penetrate into the part, is completely squeezed by the central wedges 40 (FIG. 9) and 43, whereas that (the volume of metal of the peripheral sections 69 (FIG. 15) of the part 17, being formed, is completely squeezed by the wedges 39 (FIG. 9), 41, 42 and 44. The wedges 39, 40 and 41 of the components 7 and 14 squeeze the part 17 being formed by their forming edges 45 and 46 displacing the metal from the central portion of the part 17 (FIG. 15) to its end faces. The cylindrical surfaces of the sections 68 (FIG. 15) of the formed part 17 are squeezed by the calibrating planes 6*b*, 13*b* (FIG. 9) of the wedges 39, 40 and 41, the latter (the wedges 39 (FIG. 8), 40 and 41), as well as the wedges 42, 43 and 44 being fastened on the fixed plate 9 and movable plate 3 so that the angle "$\phi$" between the forming edges 45 and 46 of the adjacent wedges 39 through 44 will offset elongation of the sections 67 (FIG. 15) of the formed part 17 during its processing.

This ensures the same forming conditions for each section 70 of the formed part 17 and precludes its distortion and twisting.

Where parts 17 to be formed are in low-ductility materials, it is expedinet that the forming tools 6 and 13 be used, each wedge of said tools be fitted, according to the invention, with two forming edges 47 with a variable angle of elevation "$\gamma$", as shown in FIGS. 10 through 13.

During forming the wedges 58 through 63 penetrate into the part 17 being formed with all their forming edges 48 simultaneously. Each of said wedges 58 through 63 displaces the volume of metal of the part 17 being formed, mounted on both sides of the forming edge 48. Where the wedges 58 through 63 are provided with the forming edges 47 inclined equally towards the plane 49, equal volumes of metal will be displaced on both sides of the forming edge 48 of the wedge 58. In this case the thrust forces brought about by the action of each of said forming edges 47 on the formed part 17 are counted balanced, a feature obviating axial displacement of the part.

Figure 16:
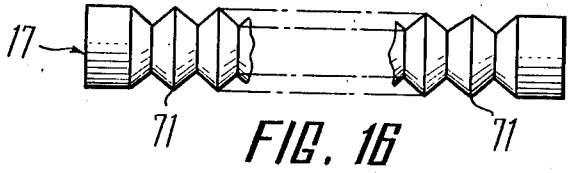
FIG. 16 depicts a part being formed by the first component of said forming tools with each wedge of each tool component having two forming edges producing on their intersection a forming blade.

A typical part 17 produced by wedge-forming by the components 7 and 14 of the forming tools 6 and 13 is illustrated in FIG. 16. As said part 17 is fed to the next components 8 and 15, it is oriented so that the forming edges 48 will come into contact with its projection 71. During forming each of said forming edges 48 incising into one of said projections 71 interacts therewith up to the end of the stroke of the movable plate 3. This is provided owing to the angle $\phi$ between the forming edges 47 in each pair of the wedges 58 – 63 and because the sections carrying said wedges 58 – 63 are mounted reciprocably in a direction perpendicular to the longitudinal slideways 2, i.e. elongation of the corresponding portions of the part 17 is made up for by said angle $\phi$ and by the edges displacing in the above direction.

Figure 10:
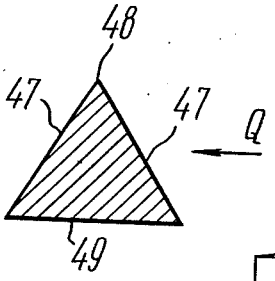
FIG. 10 shows, a scaled-up cross-sectional view of a wedge, according to the invention (one of particular embodiments)
Figure 17:
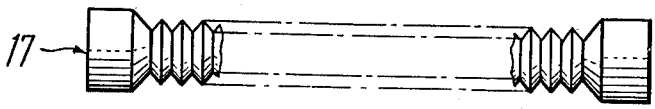
FIG. 17 shows the same as FIG. 16, but with the part being formed by the next components of said forming tool.
Figure 18:
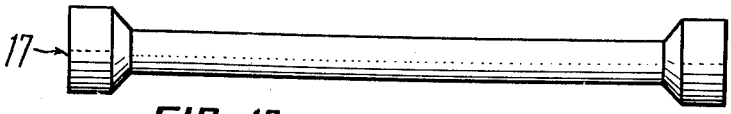
FIG. 18 shows a part processed by a forming tool given in FIG. 12.

On being formed by the components 8 and 14 the part 17 has an appearance shown in FIG. 17. As to the next components (not shown in the drawing) of the forming tools, the formed part 17 is oriented and forming is effected in strict compliance with the above-outlined procedure. The appearance of the part 17 on completion of the forming operation is shown in FIG. 10.

Forming by the wedges 58 through 63 which is accomplished with the aid of the forming edges 48 allows the stresses in the axial portion of the part 17 being formed to be reduced and ensures the forming of parts in low-ductility materials without fructuring of the central portion of their cross-section.

Where an assymmetrical part 17 with steps of various diammeter is to be formed, it is expedient that the forming tools 6 and 13 with stepped forming edges be used, as shown in FIG. 14.

The provision of the transverse cuts on the stages 65, as well as their arrangement at the same height with respect to the base plane 66 of each wedge ensure rotation of said part 17 being formed without slipping and with the same angular velocity on the part sections located in the areas of deformation, which precludes both the twisting of the formed part 17 and its distortion during forming.

What we claim is:

1. A transverse wedge forming machine, comprising a housing; longitudinal slideways enclosed in said housing; a movable plate mounted in said longitudinal slideways; a fixed plate mounted in said housing for movement towards said movable plate and parallel thereto; two wedge-shaped forming tools mounted concordantly to said longitudinal slideways; one of said forming tools being arranged on said movable plate, each of said tools comprising components having tool tops and end faces, one tool top being directed toward movement the transfer of said movable plate during the forming operation; the other one of said forming tools being mounted on said fixed plate, its top being directed toward the side opposite to the direction of the first forming tool; a clearance between said forming tools to receive a part being formed; said components being disposed in a single row in a direction normal to said longitudinal slideways; the tops of adjacent components being directed at the opposite sides; a device mounted on said fixed plate for transferring a part being formed from an end face of the previous component of said forming tool to the end face of the next component from the side of its top.

2. A machine of claim 1, wherein each of said forming tool components is made up of at least three wedges mounted in a single row in a direction normal to the longitudinal slideways, the tops of said wedges in each component being directed at the same side and the forming edges of the adjacent wedges being located at an angle to each other.

3. A machine of claim 2, wherein each wedge of each forming tool component is fitted with two forming edges producing on their intersection a forming blade running along the entire length of said wedge.

4. A machine of claim 3, wherein the forming edges of each wedge have variable angles of elevation increasing toward their tops.

5. A machine of claim 3, wherein the wedges of each of said components of the forming tools are mounted on each of the plates by means of a holder built up of sections arranged in a single row in a direction normal to the longitudinal slideways and reciprocabily in the same direction, the wedges being rigidly fixed on each of said sections.

6. A machine of claim 5, wherein at least one of the extreme holder sections is spring-biased towards its adjacent section.

7. A machine of claim 2, wherein the forming edges of each of said forming tools are stepped, said steps being formed by stages parallel to the wedge plane, said plane facing the plates carrying said wedges, the stages being located at the same height for all said wedges with respect to said plane.

8. A machine of claim 7, wherein the stages have with transverse grooves.

9. A machine of claim 1, further comprising carriages mounted parallel to each other in guides running on the fixed and movable plate planes, said carriage face each other, in a direction at right angles to the longitudinal slideways, and are arranged one above the other when the movable plate is brought into one of its extreme positions, and each carry a platform adaptable for arranging the part being formed thereon, wherein the carriage mounted on the fixed plate is a driven one.

10. A machine of claim 9, wherein the platform mounted on the carriage of one of said plates is spring-biased towards the other plate.

11. A machine of claim 1, wherein the fixed plate is secured in the housing by pins to preclude its displacement from the longitudinal slideways.

* * * * *